US005635692A

United States Patent [19]

Ward, Jr.

[11] Patent Number: 5,635,692

[45] Date of Patent: Jun. 3, 1997

[54] CONTACT ARRANGEMENT FOR ELECTRICAL APPARATUS

[75] Inventor: Robert H. Ward, Jr., Mundelein, Ill.

[73] Assignee: S & C Electric Company, Chicago, Ill.

[21] Appl. No.: 444,082

[22] Filed: May 17, 1995

[51] Int. Cl.[6] ..... H01H 33/14

[52] U.S. Cl. ..... 218/146; 218/6

[58] Field of Search ..... 218/1, 2, 4–6, 218/8, 9, 11, 12, 16–20, 45, 79, 80, 100, 102, 143–146

[56] References Cited

U.S. PATENT DOCUMENTS

| | | | |
|---|---|---|---|
| 3,584,170 | 6/1971 | Bould | 200/146 |
| 3,588,406 | 6/1971 | Bernatt | 200/144 |
| 3,787,651 | 1/1974 | Chabala et al. | 200/146 R |
| 4,107,487 | 8/1978 | Evans | 200/48 KB |
| 4,695,918 | 9/1987 | O'Leary | 361/58 |
| 5,013,876 | 5/1991 | Chabala | 200/254 |
| 5,160,817 | 11/1992 | Wiktor et al. | 200/146 R |

*Primary Examiner*—Michael L. Gellner
*Assistant Examiner*—Michael A. Friedhofer
*Attorney, Agent, or Firm*—James V. Lapacek

[57] ABSTRACT

A contact arrangement is provided for engaging first and second stationary contacts in a predetermined sequential manner, for example so as to appropriately provide a pre-insertion function via the first contact and prior to engagement of the second contact that provides a circuit-closing function in a main current path. In a preferred arrangement, the moving contact of the contact arrangement includes first and second contact surfaces that are spaced apart and parallel to each other, the first and second contact surfaces of the moving contact sequentially engaging the first and second stationary contact surfaces respectively during closing movement. In a specific embodiment, the first and second contact surfaces are provided by a unitary contact member having a circular cross-section, this arrangement being especially suited for a switch where the contact member is rotated as it moves to the closed position.

10 Claims, 2 Drawing Sheets

CONTACT ARRANGEMENT FOR ELECTRICAL APPARATUS

BACKGROUND OF THE INVENTION

1. Field of the Invention

The present invention relates generally to contact arrangements for electrical apparatus and more particularly to an arrangement where first and second contact portions of a moving contact assembly are arranged to efficiently and consecutively engage respective first and second stationary contacts.

2. Description of the Related Art

Various contact arrangements are provided for electrical apparatus such as switches to achieve desired contact engagement and electrical circuit connections. For example, U.S. Pat. Nos. 3,588,406 and 4,695,918 are directed to contact arrangements where a electrical component is inserted into the circuit prior to the engagement of the main contacts of the switch. Other contact arrangements, for example as shown in U.S. Pat. Nos. 3,787,651 and 4,107,487, connect a shunt contact path in parallel with a main contact path such that the shunt contact path is established prior to the opening of the main contacts; circuit interruption being accomplished via the shunt path after the main contacts have achieved a predetermined degree of separation. The contact arrangement of U.S. Pat. No. 3,787,651 also includes arcing contacts which are engaged prior to the engagement of the stationary main contact by the blade that carries the shunt and arcing contacts. A variation of this arcing contact arrangement is shown at page 12 of S&C Electric Company Descriptive Bulletin 761–30, dated Apr. 16, 1984. Another type of contact arrangement shown in U.S. Pat. No. 5,013,876 utilizes the orientation and configuration of two contacts to provide different areas of engagement of the contact surfaces as the contacts move into engagement, i.e. from initial contact to the closed position.

While the prior art arrangements are generally useful to provide predetermined specific contact engagement between various contacts, it would be desirable to provide a more efficient contact arrangement to efficiently achieve the consecutive engagement of two stationary contacts, especially where the moving contact also rotates as it moves between the open and closed positions.

SUMMARY OF THE INVENTION

Accordingly, it is a principal object of the present invention to provide an arrangement that efficiently achieves the consecutive or sequenced engagement of two stationary contacts by a movable contact arrangement.

It is another object of the present invention to provide a contact arrangement that includes a moving contact that rotates as it moves between opened and closed positions and has spaced apart parallel contact surfaces that consecutively engage first and second stationary contacts.

These and other objects of the present invention are efficiently achieved by the provision of a contact arrangement for engaging first and second stationary contacts in a predetermined sequential manner, for example so as to appropriately provide a pre-insertion function via the first contact and prior to engagement of the second contact that provides a circuit-closing function in a main current path. In a preferred arrangement, the moving contact of the contact arrangement includes first and second contact surfaces that are spaced apart and parallel to each other, the first and second contact surfaces of the moving contact sequentially engaging the first and second stationary contact surfaces respectively during closing movement. In a specific embodiment, the first and second contact surfaces are provided by a unitary contact member having a circular cross-section, this arrangement being especially suited for a switch where the contact member is rotated as it moves to the closed position.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
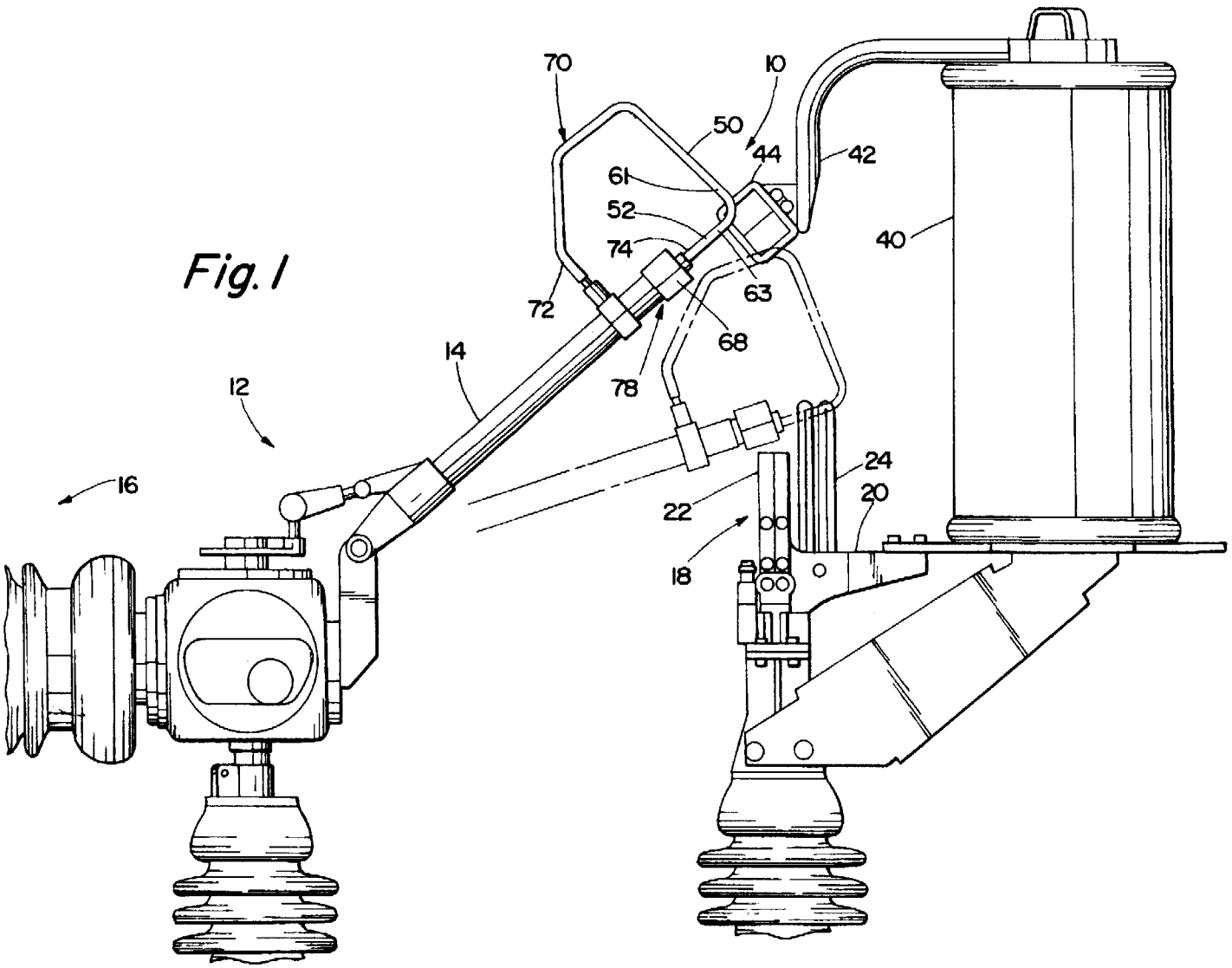
FIG. 1 is an elevational view of the contact arrangement of the present invention shown in conjunction with a switch.
Figure 2:
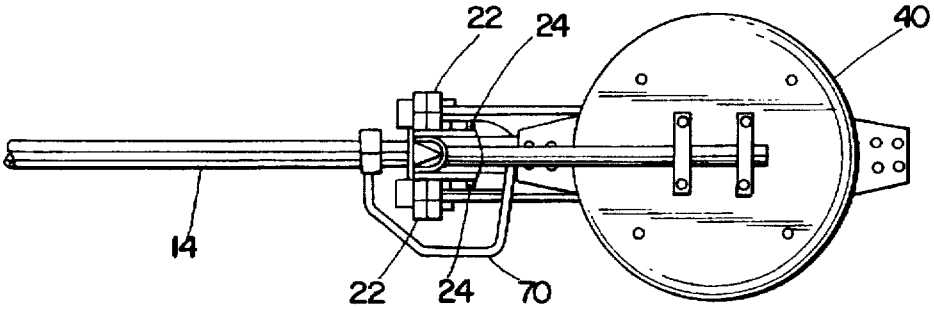
FIG. 2 is a partial top plan view of FIG. 1, but with a switch blade of the switch in a closed position.

Referring now to FIGS. 1 and 2, the contact arrangement 10 of the present invention is shown in conjunction with an illustrative switch 12 which is of the general type as shown in U.S. Pat. Nos. 3,588,406 and 4,695,918. The switch 12 includes a switch blade 14 that is movable between opened and closed positions to provide desired opening and closing of a circuit path. In the closed position, the switch blade 14 connects a power source connection at 16 to the main (current-carrying) stationary contact 18 which is connected to a line terminal at 20. The main stationary contact 18 is a jaw contact and includes spaced apart contact fingers 22 and further includes spaced apart arcing fingers 24.

Due to the presence of capacitor banks and the like in the circuit, there may be substantial inrush current and/or voltages when the switch 12 is closed. The arcing fingers 24 cooperate with the contact arrangement 10 to prevent arcing between the switch blade 14 and the contact fingers 22 during the closing of the switch blade 14, i.e. the contact arrangement 10 approaches the arcing fingers 24 before coming within arcing distance of the contact fingers 22. In order to limit the transient inrush current and/or voltages, a pre-insertion inductor 40 is arranged to be connected in series with the circuit and particularly in series with the switch blade 14 as it is being moved toward the closed position. The pre-insertion inductor 40 is chosen so as to have sufficient electrical and thermal capacity to withstand, momentarily, the current flow that may take place upon closure of the switch 12. The pre-insertion inductor 40 is supported on the switch 12 and is electrically connected between the line terminal 20 and a contact arm 42 carrying a jaw contact 44.

Figure 3:
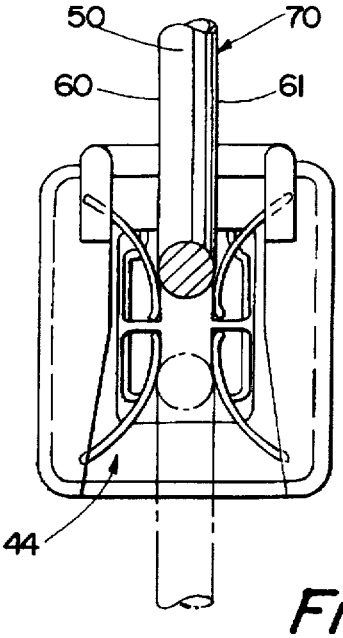
FIG. 3 is an enlarged view of a first stationary contact of the contact arrangement of FIG. 1.

In accordance with important aspects of the present invention and referring additionally now to FIG. 3, the contact arrangement 10 includes first and second contact portions 50 and 52 which are sequentially engaged by the jaw contact 44 and the arcing fingers 24 respectively as the switch blade 14 is moved toward the closed position, such that the pre-insertion inductor 40 is connected in circuit between the connections 16, 20 at a predetermined point in the closing movement and before the switch blade 14 engages the arcing fingers 24 of the main contact 18. Further, the contact arrangement 10 is also effective to bypass the pre-insertion inductor 40 upon further closing movement.

Accordingly, the contact arrangement 10 provides first and second contact portions 50, 52 that define spaced apart contact surfaces 60, 61 and 62, 63, respectively, that are each parallel to the other, with the contact surfaces 60, 62 and 61, 63 also being coplanar. Further, the contact portions 50, 52 (and the contact surfaces 60, 61 and 62, 63) are arranged at a predetermined angle to each other that is desirable in accordance with the particular switch configuration and geometrical relationship between the stationary contacts, the jaw contact 44 being referred to as a first stationary contact, and the arcing fingers 24 being referred to as a second stationary contact. For example, the first and second contact portions 50, 52 of the contact arrangement 10 are generally in the range of 80–90 degrees apart, defining a generally L-shaped, moving contact configuration. Thus, the first and second contact portions 50, 52 sequentially engage the first and second stationary contacts 44, 24 respectively as the switch blade 14 moves from the opened to the closed position. Additionally, the length or expanse of the contact portion 50 is determined to provide the desired spacing between the stationary contacts 44 and 24 and the desired insertion duration as measured in degrees of closing stroke which corresponds to a time duration at a predetermined closing speed.

Figure 5:
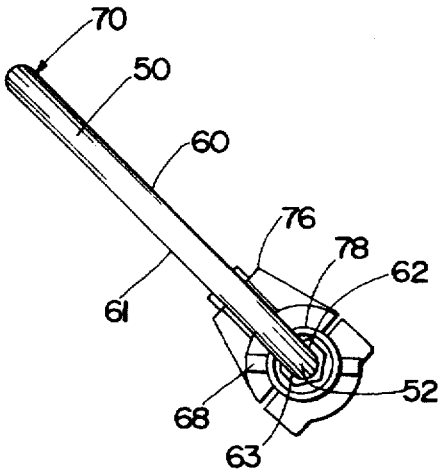
FIGS. 4 and 5 are respective, enlarged front and left-side elevational views of a portion of a moving contact assembly of the contact arrangement of FIGS. 1 and 2.
Figure 4:
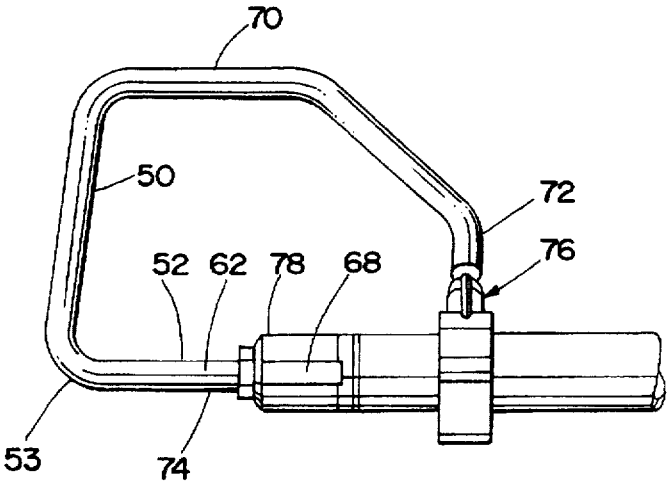

In the illustrative switch 12, the switch blade 14 rotates during the final portions of the closing movement, i.e. about the longitudinal axis of the switch blade 14 in order to provide high pressure contact engagement between the contact fingers 22 and a tongue contact 68 of a blade tip assembly 78 carried by the switch blade 14. Referring now additionally to FIGS. 4 and 5, the tongue contact 68 defines widened portions on the periphery of the blade tip assembly 78. The tongue contact 68 provides desired contact engagement pressure with the contact fingers 22 as the switch blade 14 is rotated a predetermined number of degrees during the final closing movement of the switch blade 14; the widened portion of the contact tongue 68 being aligned to engage the contact fingers 22 in the closed position. The rotation of the switch blade 14 begins as the first contact portion 50 is leaving the jaw contact 44; i.e. as the first contact portion 50 moves beyond the position shown in phantom in FIG. 3. To this end, the structure of the jaw contact 44 is arranged to accommodate the rotation of the first contact portion 50 while still maintaining contact engagement.

In accordance with additional features of the present invention, in the illustrative embodiment of FIGS. 1–5, the first and second contact portions 50, 52 of the contact arrangement 10 are provided by a unitary contact member 70 having two ends 72, 74. The end 72 is affixed to the switch blade 14 by means of a clamp fitting 76. The second end 74 is affixed into the center of the blade tip assembly 78. In the preferred embodiment, the unitary contact member 70 is formed from a rod, the circular cross-section being desirable to accommodate the applications where the switch blade 14 rotates during closing, e.g., contact engagement being maintained between the second contact portion 52 and the arcing fingers 24 as the switch blade 14 rotates. Additionally, the circular cross-section allows a wide latitude in alignment with the first stationary contact 44. The curved portion or bight 53 (FIG. 4), intermediate the first and second contact portions 50, 52, functions during the pre strike of the contact arrangement 10 with the arcing fingers 24; the contact arrangement 10 in the illustrative embodiment of FIGS. 1–5 being arranged in a "break before make" configuration such that the jaw contact 44 is disengaged before engagement of the arcing fingers 24. However, it should be understood that in other specific embodiments, the contact arrangement 10 is arranged in "make before break" configurations.

The cross-section of the unitary contact member 70 is selected to satisfy the requirements of the overall functions provided. In the illustrative embodiment of FIGS. 1–5, the bight 53 requires the highest cross-section due to arcing considerations; i.e. requiring a larger cross-section than that of the first and second contact portions 50, 52. In one specific embodiment, the unitary contact member 70 is fabricated from a tin-plated, silicon-bronze alloy/#655, ASTM-B-98 hard drawn.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed and desired to be secured by Letters Patent of the United States is:

1. A contact configuration for use in an electrical switch configuration including a pre-insertion component that is inserted into a circuit during a closing movement of the switch configuration, the contact configuration comprising first and second spaced apart stationary contacts, and a movable contact assembly comprising a generally L-shaped contact member having first and second contact portions that are arranged to respectively and sequentially engage said first and second stationary contacts during closing movement of said movable contact assembly, said pre-insertion component being connected between said first and second stationary contacts.

2. The contact arrangement of claim 1 wherein said first and second stationary contacts comprise jaw contacts and said first and second contact portions each have a generally circular cross-section.

3. The contact arrangement of claim 2 wherein said movable contact assembly includes an elongated switch blade defining a longitudinal axis, said elongated switch blade being rotated about said longitudinal axis during closing movement.

4. The contact arrangement of claim 3 wherein said generally L-shaped contact member defines a plane with said first and second contact portions being generally coplanar.

5. The contact arrangement of claim 1 wherein said movable contact assembly further comprises an elongated switch blade and means for attaching said first and second contact portions of said L-shaped contact member to said switch blade.

6. The contact arrangement of claim 1 wherein said movable contact assembly further comprises a switch blade and an elongated conductor having first and second ends carded by said switch blade, said elongated conductor defining said first and second contact portions of said L-shaped contact member.

7. The contact arrangement of claim 6 wherein said elongated conductor has a generally circular cross-section.

8. A contact arrangement for electrical apparatus including first and second stationary contacts and a movable contact assembly including first and second movable contacts movable with said movable contact assembly, said first movable contact defining a first contact surface, said second movable contact defining a second contact surface, said first and second contact surfaces being parallel to each other, the contact arrangement further including means for moving said movable contact assembly so that said first movable contact engages said first stationary contact followed by said second movable contact engaging said second stationary contact, said movable contact assembly comprising an elongated member having a generally circular cross-section and defining said first and second movable contacts, said movable contact assembly further comprising a switch blade that carries said elongated member, said elongated member being conductive, said elongated member including first and second ends, each of said first and second ends being affixed to said switch blade.

9. The contact arrangement of claim 8 wherein said first and second movable contacts are arranged to define a predetermined angle between each other.

10. The contact arrangement of claim 8 wherein said first and second stationary contacts are jaw contacts.

* * * * *

UNITED STATES PATENT AND TRADEMARK OFFICE

CERTIFICATE OF CORRECTION

PATENT NO. : 5,635,692

DATED : Jun. 3, 1997

INVENTOR(S) : Robert H. Ward, Jr.

It is certified that error appears in the above-identified patent and that said Letters Patent is hereby corrected as shown below:

Col. 4, line 13, "alloy/#655" should be -- alloy #655 -- (remove slash and insert space); and Col. 4, line 56, claim 6, "carded" should be -- carried --.

Signed and Sealed this

Seventh Day of October, 1997

*Attest:*

Bruce Lehman

BRUCE LEHMAN

*Attesting Officer*

*Commissioner of Patents and Trademarks*